United States Patent [19]

Roberge

[11] Patent Number: 4,636,926

[45] Date of Patent: Jan. 13, 1987

[54] ASSEMBLY FOR MOUNTING A LIGHT FIXTURE TO A SUPPORT STRUCTURE

[76] Inventor: Jacques Roberge, 5650 Trudeau Street, St-Hyacinthe (Québec), Canada

[21] Appl. No.: 705,692

[22] Filed: Feb. 26, 1985

[51] Int. Cl.[4] ..... F21V 17/06

[52] U.S. Cl. ..... 362/353; 362/433

[58] Field of Search ..... 362/267, 362, 374, 375, 362/396, 408, 433, 434, 440, 442, 453, 277, 306, 353, 355, 437, 443, 363, 134

[56] References Cited

U.S. PATENT DOCUMENTS

| | | | |
|---|---|---|---|
| 1,885,655 | 11/1932 | Volk | 362/433 |
| 2,714,654 | 8/1955 | Poglein | 362/433 |
| 3,283,145 | 11/1966 | Muller et al. | 362/433 |
| 3,524,981 | 8/1970 | Auerbach | 362/433 |
| 3,944,809 | 3/1976 | Moore et al. | 362/433 X |
| 4,099,224 | 7/1978 | Valpey | 362/433 |

FOREIGN PATENT DOCUMENTS

| | | | |
|---|---|---|---|
| 2417649 | 11/1975 | Fed. Rep. of Germany | 362/433 |

*Primary Examiner*—Willis R. Wolfe, Jr.

*Attorney, Agent, or Firm*—Cushman, Darby & Cushman

[57] ABSTRACT

A series of resilient blades are circumferentially disposed on an annular member to which a light fixture is attached and are adapted, through a rotational sliding motion, to come in overlapping interengagement with a second series of resilient blades disposed circumferentially on a base member mounted to the structure supporting the light fixture.

13 Claims, 12 Drawing Figures

ASSEMBLY FOR MOUNTING A LIGHT FIXTURE TO A SUPPORT STRUCTURE

FIELD OF THE INVENTION

The present invention pertains to an assembly for mounting a light controlling device such as a diffuser or the like to a structure supporting the light fixture.

BACKGROUND OF THE INVENTION

One presently known assembly of this kind consists of an annular member which is adapted to be mounted to the light fixture and of a base member which is adapted to be mounted to the supporting structure. The inner engagement between the base member and the annular member is effected through a relative rotational movement such that circumferentially spaced lugs on the inner rim of the annular member frictionally engage corresponding lugs on the outer peripheral wall of the base member. However, this frictional metal-to-metal contact has drawbacks in that a tight rigid engagement is rarely achieved and, in cases where it is achieved, it is rather a jammed engagement where disengagement between the annular and base members may in time become extremely difficult. To maintain an adequate rigid and sealing engagement between the parts (in order to prevent disengagement through vibration when a rigid engagement is not achieved), a pressure screw extending through the base member is used to exert force against the annular member and to lock the two members together. However, tightening this screw causes separation between the two parts in areas where there are no lugs thereby defeating its own purpose of preventing rain or snow from penetrating inside the assembly. It is essential that no gap be present because of the possibility of having rain or snow penetrating inside the assembly to corrode and damage the light socket and/or ballast. Indeed, present systems relying on aluminum-to-aluminum or steel-to-steel contact are difficult to operate after exposure to corrosive atmosphere often encountered in street and area lighting conditions.

Furthermore, it has been found that in cases where the light fixture is not transparent, it is extremely difficult to mount the fixture to the annular member. The latter is a cast member; all parts are therefore integral such as the threaded pins which protrude on the fixture side of the annular member and are used to secure two semispheric brackets which, in turn, serve to tighten the light fixture to the annular member. The user must therefore work in a very ackward position, that is, he must insert his hands through the central opening of the annular member to reach the fastening and the fastened parts where it becomes very difficult to secure the parts together.

OBJECTS AND STATEMENT OF THE INVENTION

It is an object of the present invention to provide an assembly where the above-described drawbacks are avoided. This is achieved by providing an assembly where contact between the annular member and the base member is obtained through a series of resilient engaging means which are adapted to come in overlapping interengagement through a rotational sliding movement, and through a sealing means between the annular member and the base member, pressure being exerted on the sealing means by the resilient engaging means.

The present invention, therefore, relates to an assembly for mounting a light fixture to a support structure which comprises: a base member for connection to the support structure; an annular member for connection to the light fixture; first engaging means mounted to the base member; second engaging means mounted to the annular member; and sealing means between the annular member and the base member. The first and second engaging means are overlappingly interengageable through a relative rotational sliding motion between the annular member and the base member. Each locking means consists of a blade made of resilient material and includes a portion thereof having a configuration that enables overlapping portions to be blocked into an overlapping interengagement.

One feature of the present invention is that the light fixture is supported through a series of resilient blades thus avoiding contact between the annular member and the base member which are now separated by the sealing means.

Another feature of the present invention is that the arrangement of the means fastening the second engaging means to the annular member are accessible from outside the annular member and the light fixture, thereby providing easy and quick installation or dismounting of the parts to and from one another.

Another feature of the present invention is that it is self-locking in that the base member and the annular member, once in position, cannot be separated through vibration, even in the absence of a locking screw.

In one embodiment of the invention, a screw is used as an additional locking feature; the screw is so devised as to not exert pressure between the base member and the annular member.

Other objects and further scope of applicability of the present invention will become apparent from the detailed description given hereinafter. It should be understood, however, that this detailed description, while indicating preferred embodiments of the invention, is given by way of illustration only, since various changes and modifications, within the spirit and scope of the invention, will become apparent to those skilled in the art.

BRIEF DESCRIPTION OF THE DRAWINGS

For a better understanding of the present invention, reference is had to the following description taken in connection with the accompanying drawings in which.

DESCRIPTION OF PREFERRED EMBODIMENTS

Figure 1:
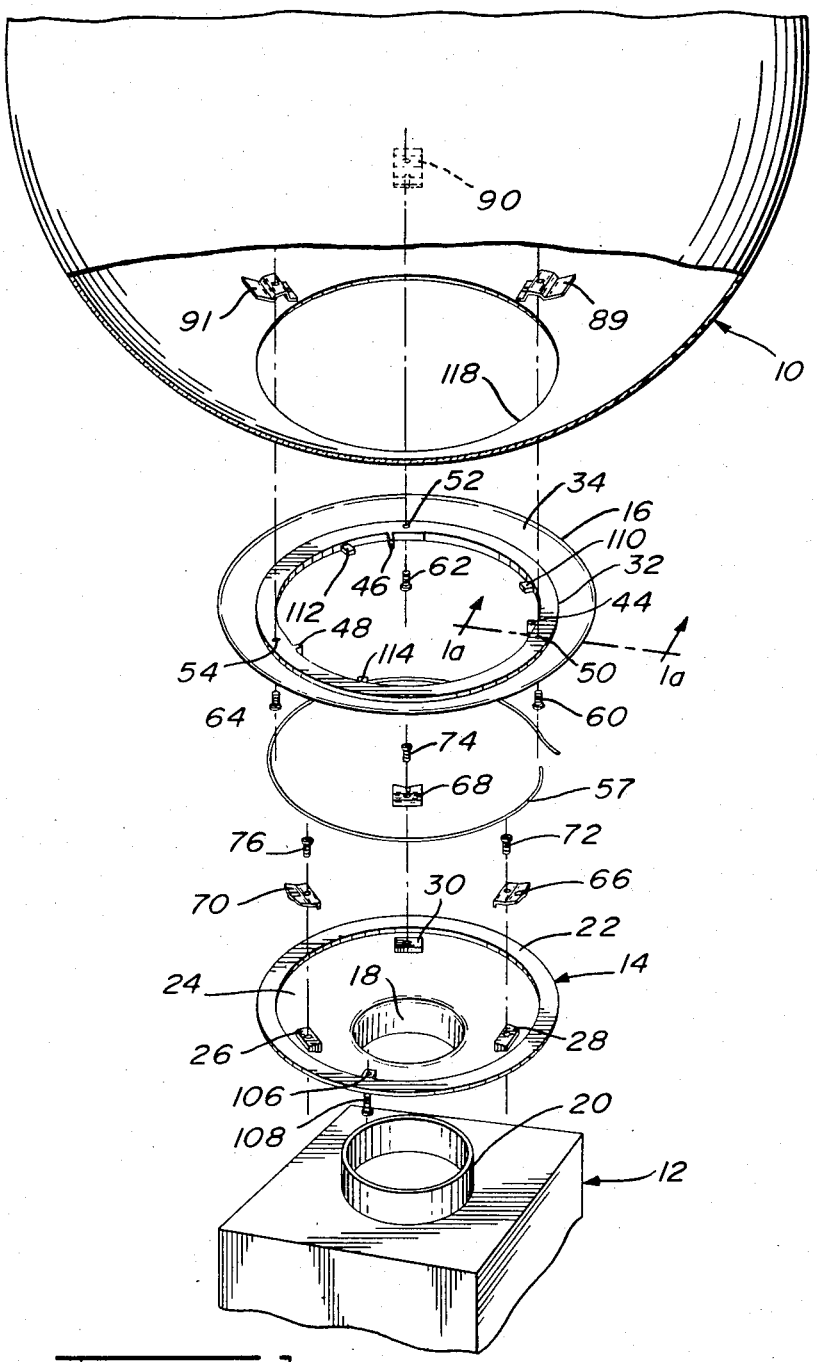
FIG. 1 is an exploded view showing the various components of the assembly made in accordance with the present invention.

Referring to FIG. 1, there is shown assembly for mounting a light fixture in the form of a sphere 10 to a support structure 12 in which may be received a bulb socket with or without a ballast to provide illumination inside the fixture, the latter being capable of having various shapes and configurations.

The assembly comprises a base member 14 adapted to be mounted to the support structure and an annular member 16 adapted to be mounted to the light fixture 10.

The base member 14 has a neck portion 18 which is adapted to be engaged into a complementarily shaped neck portion 20 on the support structure 12. The upper portion of the base member has an annular flat surface 22 joined to the neck portion 18 through a frustum portion 24 on which are integrally formed three circumferentially spaced lugs 26, 28 and 30.

Figure 1A:
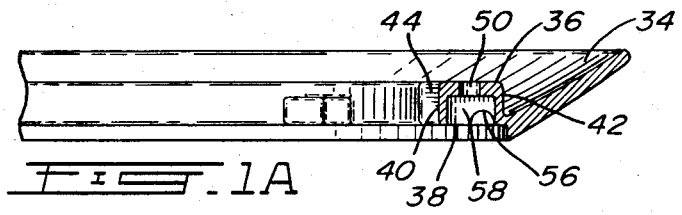
FIG. 1*a* is a cross-sectional view taken along lines 1*a*–1*a* of FIG. 1.

The annular member 16 has a portion 32 and an outwardly extending frustum-shaped portion 34. Referring to FIG. 1*a*, the rim portion has a flat top wall 36, a bottom wall 38, an inner wall 40 and an outer wall 42. The inner wall 40 displays a series of projecting lugs 44, 46, 48, serving as stoppers as described hereinbelow. Three circumferentially spaced holes 50, 52 and 54 traverse vertically the rim portion 32. The bottom wall displays a semi-circular groove recess 56 extending circumferentially thereof. In the area of holes 50, 52 and 54, groove 56 is further recessed in the form of a cylindrical wall 58 to receive therein the head of screws 60, 62 and 64 respectively. The semi-circular groove 56 serves to receive a sealing gasket in the form of an O'ring 57.

Figure 2:
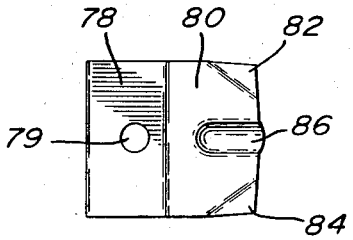
FIGS. 2, 3 and 4 are top, side and front views respectively of the first engaging means on the base member.
Figure 3:
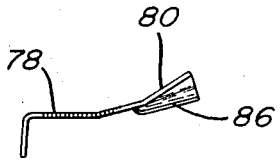
Figure 4:
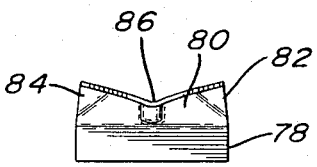

To each lug 26, 28, 30 of the base member 14 is affixed a corresponding blade 66, 68, 70 respectively, by means of fastening screws 72, 74, 76. Referring to FIGS. 2, 3 and 4, each blade includes an L-shaped portion 78 that sits on its associated lug and a deformed portion 80, the latter including bent edges and corners 82, 84 and a centrally disposed rounded depression 86. The L-shaped portion 78 has a circular opening 79 to receive the fastening screw to affix the blade to the lug. Once installed, the deformed portion 80 extends at a distance above surface 24.

Figure 5:
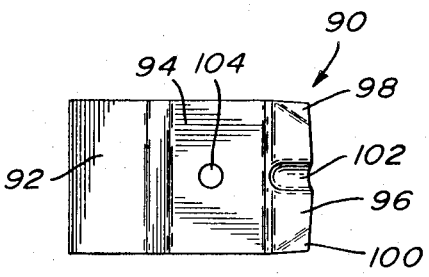
FIGS. 5, 6 and 7 are top, side and front views respectively of the second engaging means on the annular member.
Figure 6:
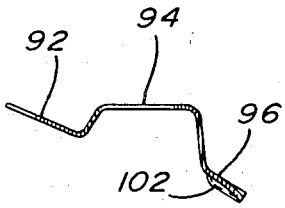
Figure 7:
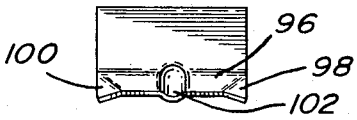

Referring to FIGS. 5, 6 and 7, a second set of blades 89, 90, 91 is shown and is adapted to be mounted on the rim portion of the annular member 16. Blade 90 includes a first portion 92 having an inclination corresponding substantially to that of the frustum surface 34 of the annular member, a rectangular shaped portion 94 adapted to sit on the top wall 36 and a lower portion 96 which is deformed in a manner similar to that of blades 66, 68, 70, mounted to the base member. The deformed portion 96 includes bent edges and corners 98 and 100 and a rounded central indentation 102. An opening 104 is provided in portion 94 of the blade and is threaded to accept screws 60, 62, 64.

Referring to FIG. 1, the base member 14 has inwardly projecting from the flat surface 22 a projecting lug 106 having an opening to receive therethrough a screw 108. From wall 40 of the annular member 16, a series of circumferentially spaced lugs 110, 112 and 114 project inwardly and are adapted to come in vertical juxtaposition over lug 106 upon full interengagement.

The assembly of the various components of the present invention will now be described. The light fixture 10 is positioned so as to have edge 118 of its circular opening resting on the top portion of the frustum-shaped portion 34 of the annular member and against wall 42. Blades 89, 90 and 91 are then positioned on the top face 36 of the rim portion of the annular member. Screws 60, 62, 64 are inserted to extend through openings 50, 52, 54 of the rim portion and threaded openings 104 of the blades thus securing the blades as well as the light fixture to the annular member. The heads of the screws are received in their respective wells 58. This construction avoids the problems of the prior art in that the installer does not need to reach inside the light fixture to secure the annular member to the light fixture.

Figure 8:
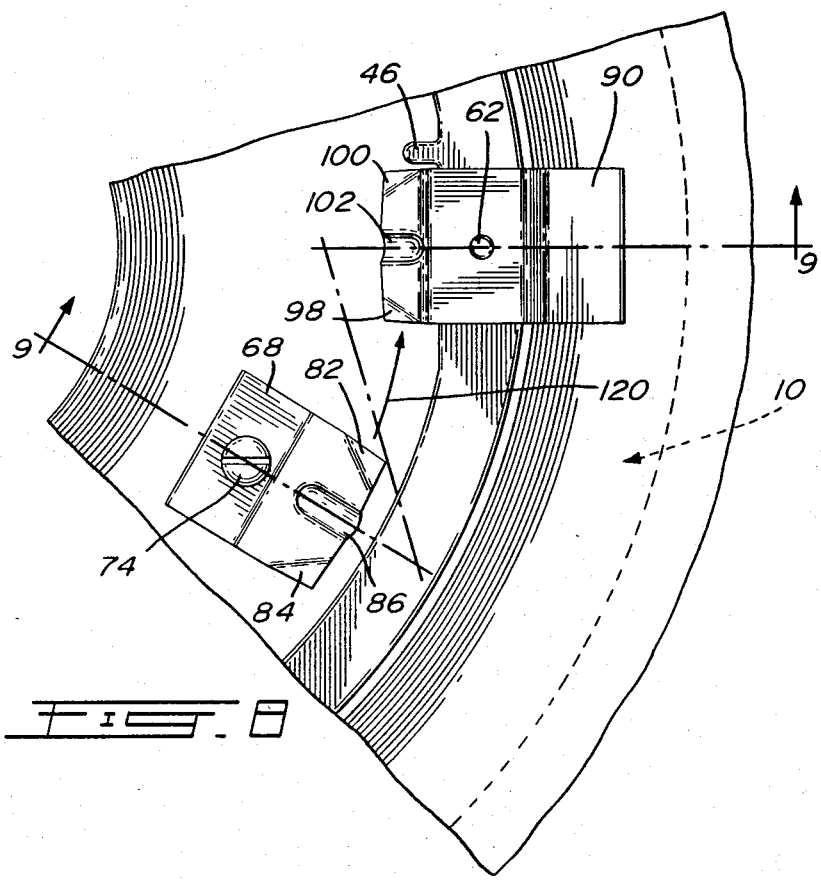
FIG. 8 is a partial top plan view of one set of engaging means prior to interengagement.

Blades 66, 68 and 70 are then positioned and mounted on lugs 26, 28, 30, respectively of the base member. The O'ring 57 is positioned in groove 56 of the annular member, preferably using an adhesive sealant at wells 58 and at as many points along the circumference as may be required. The assembly of light fixture and annular member with the O'ring is positioned on the flat surface 22 of the base member with the blades of the annular member and the blades of the base member in the position shown in FIG. 8, for example, which is a view as seen from inside the sphere. To effect an interengagement of the two sets of blades together, relative rotational motion is carried out between the annular member and the base member in the direction shown by arrow 120. Initial engagement occurs when bent corner 82 of blade 68 slides over the bent corner 98 of blade 90; the resiliency in both blades causes them to deflect slightly to allow the continual overlapping engagement until the central identation 86 snaps into engagement in the corresponding indentation 102 of blade 90. Should the rotational force exerted to provoke the interengagement between the blades be excessive where indentation 86 of blade 74 moves in and out of indentation 102, the rotation is stopped as soon as corner 82 abuts the lug 46. The engagement of the other two pairs of blades 66 with 89 and 70 with 91 is effected in the same manner and simultaneously. All sets of blades are blocked by the engagements of the indentations.

Figure 11:
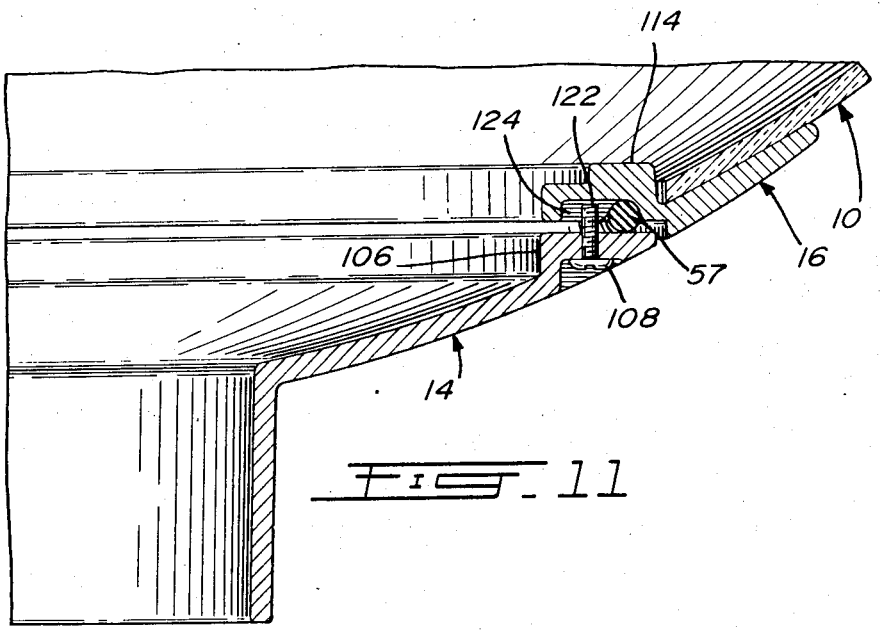
FIG. 11 is a cross-sectional view taken along lines 11—11 of FIG. 10 after final interengagement.

An additional locking engagement between the annular member and the base member may be obtained by inserting screw 108 from underneath the base member 14 through opening 106 with the upper extremity 122 of the screw received in one of the hollow lugs 110, 112 or 114 extending over lug 106 (see FIG. 11). It is preferred that the upper extremity 122 of screw 108 terminate short of the inner wall 124 of the lug 114 to avoid contacting and thus raising the annular member thereby reducing the sealing function of sealing gasket 57.

Figure 9:
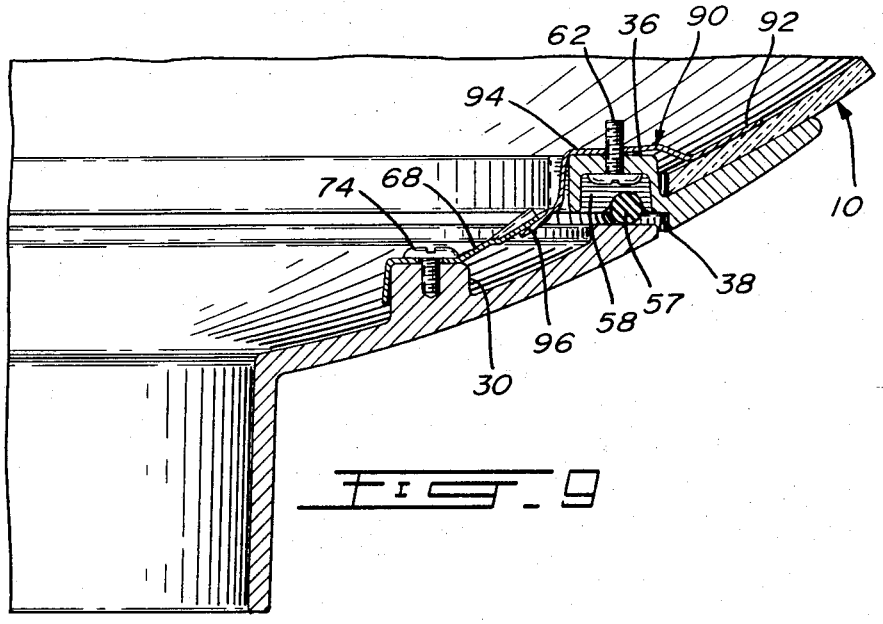
FIG. 9 is a cross-sectional view taken along lines 9—9 of FIG. 8.
Figure 10:
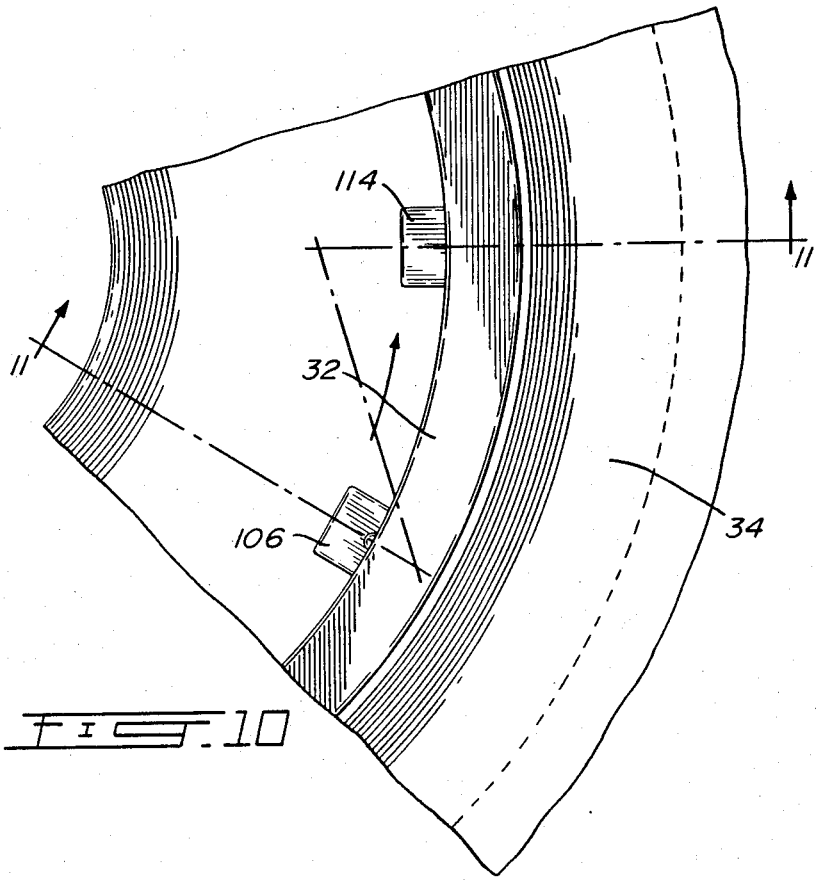
FIG. 10 is a partial top plan view showing a locking feature associated with the present invention prior to final interengagement between the annular member and the base member.

As can be seen in FIG. 9, the annular member does not contact the base member, the sealing gasket thus acting as a separator between the members.

It has been found that stainless steel No. 301 is adequately suitable for providing the resiliency required in the blades which act as supports for the annular and base members at the same time providing protection against corrosion.

Disengagement of the parts is carried out by exerting a sudden jerk thus freeing the indentations from one another after loosening the lacking screw 108, is used.

Although the invention has been described with relation to one specific form, it will be evident to persons skilled in the art that it may be refined and modified in various ways. For example, the support member could be made of plastic material, such as polycarbonate or fiberglass with the base member being made of metal. Alternatively, both support member and base member, can be made of plastic material. It is therefore wished to have it understood that the present invention should not be limited in interpretation except by the terms of the following claims.

The embodiments of the invention in which an exclusive property or privilege is claimed are defined as follows:

1. An assembly for mounting a light controlling device such as a diffuser or the like to a support structure, comprising:

a base member for connection to said support structure; an annular member for connection to said light controlling device; first engaging means mounted on said base member; said engaging means mounted on said annular member; said first and second engaging means being overlappingly interengageable through a relative rotational sliding motion between said annular member and said base member, said first and second engaging means each comprising a blade made of resilient material and including a portion thereof having a configuration that enables overlapping portions of each said first and second engaging means to be locked into an overlapping interengagement;

sealing means between said annular member and said base member, pressure being exerted on said sealing means by said first and second resilient engaging means when interengaged, said blade portions having opposite edges and corners shaped so as to facilitate initial sliding engagement between said two overlapping portions;

stop means being provided on the inner rim of said annular member and located adjacent to said second engaging means, one of said edges of said first engaging means contacting said stop means to thereby prevent said rotational sliding motion from going beyond said overlapping interengagement.

2. An assembly for mounting a light controlling device such as a diffuser or the like to a support structure, comprising:

a base member for connection to said support structure; an annular member for connection to said light fixture; first engaging means mounted on said base member; second engaging means mounted on said annular member; said first and second engaging means being overlappingly interengageable through a relative rotational sliding motion between said annular member and said base member, said first and second engaging means each comprising a blade made of resilient material and including a portion thereof having a configuration that enables overlapping portions of each said first and second engaging means to be locked into an overlapping interengagement;

sealing means disposed between said annular member and said base member, pressure being exerted on said sealing means by said first and second resilient engaging means, when interengaged, said base member having a flat, annular peripheral surface and vertical registry with a grooved annular surface on said annular member; a sealing ring being received in said grooved surface, said ring contacting said flat surface of said base member and slightly distancing said annular surfaces from one another.

3. An assembly as defined in claim 2, further comprising means for fastening said blade to said annular member being accessible from outside said lighting fixture; said grooved surface in said annular member including cavities to receive said fastening means therein; each said cavity allowing said fastening means to clear said sealing ring.

4. An assembly as defined in claim 3, further comprising an adhesive sealant in said cavities.

5. An assembly as defined in claim 2, said grooved surface of said annular member including wells; a locking means extending through said base member and having a portion received in one of said wells to lock said annular member against rotation relative to said base member.

6. An assembly as defined in claim 5, wherein said locking means terminates into said well short of the bottom wall thereof.

7. An assembly for mounting a light controlling device such as a diffuser or the like to a support structure, comprising:

a base member for connection to said support structure;

an annular member for connection to said light controlling device;

first engaging means mountable on said base member;

second engaging means mountable on said annular member; said first and second engaging means being overlappingly interengageable through a relative rotational sliding motion between said annular member and said base member; said first and second engaging means each comprising a blade made of resilient material and including a portion thereof having a configuration that enables overlapping portions of each said engaging means to be locked into an overlapping interengagement; and sealing means between said annular member and said base member, pressure being exerted on said sealing means by said first and second resilient engaging means when interengaged.

8. An assembly as defined in claim 7, wherein opposite edges and corners of said blade portion are so shaped as to facilitate initial sliding engagement between two overlapping portions.

9. An assembly as defined in claim 7, wherein the blade of said second engaging means include a second portion for securing said light fixture to said annular member.

10. An assembly as defined in claim 7, wherein said first and said second engaging means respectively consist of three circumferentially spaced blades.

11. An assembly as defined in claim 10, further comprising means for fastening said blades of said first engaging means to lugs on said base member.

12. An assembly as defined in claim 7, wherein said resilient material is stainless steel.

13. An assembly as claimed in claim 12 wherein said stainless steel is of grade 301.

* * * * *